US006954951B2

(12) United States Patent
Lieboff et al.

(10) Patent No.: US 6,954,951 B2
(45) Date of Patent: Oct. 18, 2005

(54) SPICA CAST GURNEY

(76) Inventors: Leonard Lieboff, 10536 Plainview Cir., Boca Raton, FL (US) 33498; John DelGardo, 11769 Preservation La., Boca Raton, FL (US) 33498

( * ) Notice: Subject to any disclaimer, the term of this patent is extended or adjusted under 35 U.S.C. 154(b) by 0 days.

(21) Appl. No.: 10/734,874

(22) Filed: Dec. 12, 2003

(65) Prior Publication Data

US 2005/0125898 A1 Jun. 16, 2005

(51) Int. Cl.[7] ..... A61G 7/075

(52) U.S. Cl. ..... 5/603; 5/604; 5/610; 5/621; 5/624

(58) Field of Search ..... 5/603, 604, 610, 5/621, 624, 648, 650; 128/845

(56) References Cited

U.S. PATENT DOCUMENTS

| | | | | |
|---|---|---|---|---|
| 2,035,321 A | | 3/1936 | Koenigkramer et al. | |
| 3,293,667 A | * | 12/1966 | Ohrberg | 5/610 |
| 3,423,773 A | * | 1/1969 | Yamate | 5/610 |
| 3,431,020 A | * | 3/1969 | Tyndall | 297/467 |
| 3,434,165 A | * | 3/1969 | Keane | 5/608 |
| 3,640,520 A | * | 2/1972 | Wieland et al. | 5/610 |
| 3,997,926 A | * | 12/1976 | England | 5/610 |
| 4,059,255 A | | 11/1977 | Perold | |
| 4,361,916 A | | 12/1982 | McDaniel | |
| 4,613,997 A | | 9/1986 | Langdale | |
| 4,724,554 A | | 2/1988 | Kowalski et al. | |
| 4,847,929 A | | 7/1989 | Pupovic | |
| 4,865,303 A | | 9/1989 | Hall | |
| 4,987,622 A | | 1/1991 | Shockey | |
| 5,138,729 A | | 8/1992 | Ferrand | |
| 5,303,437 A | | 4/1994 | Hung | |
| 5,489,258 A | | 2/1996 | Wohnsen et al. | |
| 5,586,349 A | | 12/1996 | Hannant | |
| 6,282,736 B1 | | 9/2001 | Hand et al. | |
| 6,405,393 B2 | | 6/2002 | Megown | |
| 6,484,332 B2 | | 11/2002 | Korver, II et al. | |

* cited by examiner

*Primary Examiner*—Michael Trettel
(74) *Attorney, Agent, or Firm*—Stephen Bongini; Fleit, Kain, Gibbons, Gutman, Bongini & Bianco P.L.

(57) ABSTRACT

A gurney is provided for a patient wearing a spica cast with a fixed bar extending between the legs. The gurney includes a base structure, a platform for holding the patient, and a bar support structure coupled to the platform. The platform is coupled to the base structure and is capable of being in at least one elevated position. The bar support structure supports the bar so as to support the patient when the platform is in the elevated position. In one embodiment, the gurney further includes a motorized elevation variance system coupled between the platform and the base structure for changing the elevated position of the platform, and the platform is rigid so as to always be substantially planar.

22 Claims, 7 Drawing Sheets

SPICA CAST GURNEY

FIELD OF THE INVENTION

This invention relates in general to medical equipment, and more particularly to gurneys.

BACKGROUND OF THE INVENTION

A spica cast (also known as a hip spica cast or body cast) is a full body cast used to immobilize a patient, such as a pediatric patient, following certain types of surgeries (e.g., various orthopedic surgeries) or injuries in order to maintain a corrected body position so that proper healing can be achieved. A spica cast can immobilize a patient so that no foot movement, no hip movement, and no bending at the waist is possible. By immobilizing the hips, thighs, and/or legs, the spica cast enables bones and/or tendons to heal properly. A patient usually must wear a spica cast for a lengthy period of time, which can be on the order of two to four months or more.

Spica casts can take a wide variety of forms. For example, a spica cast may extend from a patient's chest to their ankles and may further cover a patient's feet and toes. Other types of spica casts may extend from the chest down to cover one leg, both legs, or completely cover one leg and partially cover the other leg (e.g., down to the hip or knee). The spica cast can be made of such materials as plaster or fiberglass and can also include a liner, such as a Gore-Tex liner to keep the patient dry.

A spica cast of the type that covers both legs often includes a bar extending between the patient's legs in order to keep the patient's legs spread apart and in a proper position for healing. The bar typically extends from ankle to ankle, but can also be placed at other positions between a patient's legs.

Currently, a patient in a spica cast must lie in the prone position (on their back or stomach), with pillows used to prop up the patient's head and upper body torso. Thus, patients in a spica cast are usually bedridden in a prone position and immobilized for a lengthy period of time. Further, it requires extraordinary effort to move the patient or change the patient's position. This makes the experience very difficult for the patient, especially a pediatric patient, because the patient cannot be easily moved around for elimination or to participate in various family activities such as mealtime or television viewing.

Due to the uncomfortable existence that patients must endure while wearing a spica cast, what is needed is an apparatus that provides greater comfort and mobility for these patients.

SUMMARY OF THE INVENTION

Briefly, in accordance with one aspect of the present invention, there is provided a gurney for a patient wearing a spica cast with a fixed bar extending between the legs. The gurney includes a base structure, a platform for holding the patient, and a bar support structure coupled to the platform. The platform is coupled to the base structure and is capable of being in at least one elevated position. The bar support structure supports the bar so as to support the patient when the platform is in the elevated position. In one embodiment, the platform is rigid so as to always be substantially planar. Accordingly, the gurney allows a patient in a spica cast to be held in an upright position and, in some embodiments, to be adjusted between multiple elevated positions. This enables a patient to enjoy improved comfort and convenience compared with being confined to a prone position.

In accordance with another aspect of the present invention, there is provided a gurney for a patient wearing a spica cast with a fixed bar extending between the legs. The gurney includes a base structure, a platform for holding the patient, a bar support structure coupled to the platform, and a motorized elevation variance system coupled between the platform and the base structure. The platform is coupled to the base structure and is capable of being in a plurality of elevated positions. The bar support structure supports the bar so as to support the patient when the platform is in one of the elevated positions, and the motorized elevation variance system allows changing the elevated position of the platform. The platform is preferably rigid so as to always be substantially planar.

Other objects, features and advantages of the present invention will become apparent from the following detailed description. It should be understood, however, that the detailed description and specific examples, while indicating preferred embodiments of the present invention, are given by way of illustration only and various modifications may naturally be performed without deviating from the present invention.

DETAILED DESCRIPTION OF PREFERRED EMBODIMENTS

Figure 1:
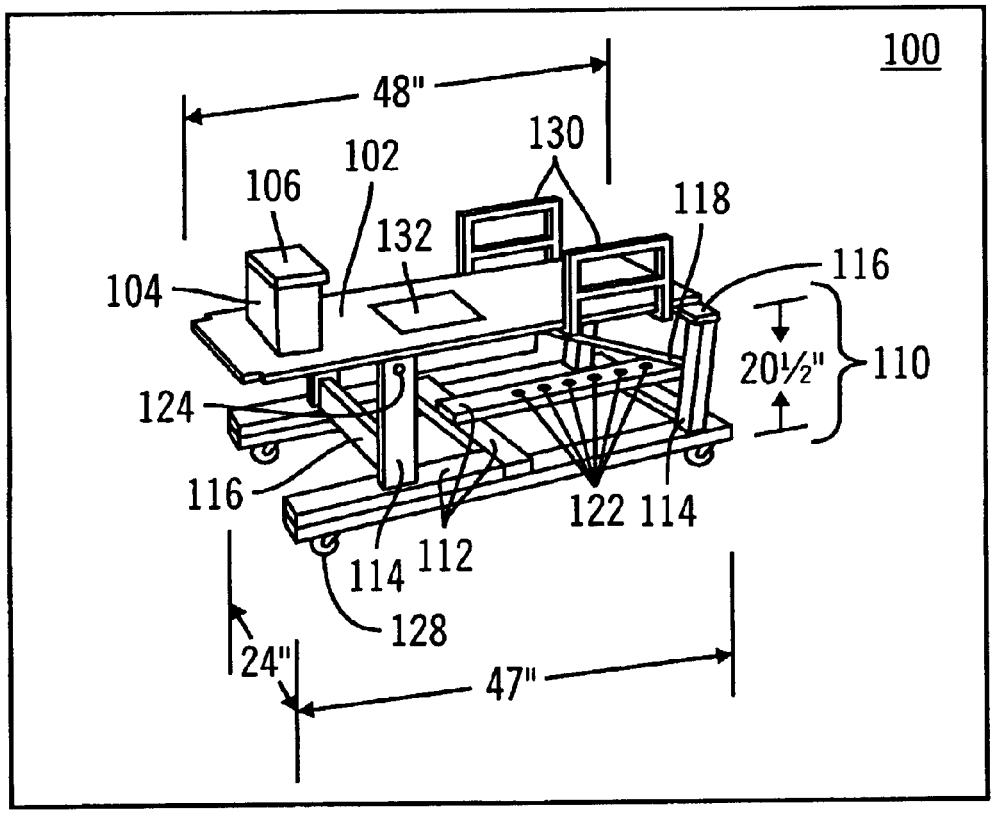
FIG. 1 is a diagram illustrating a spica cast gurney according to a preferred embodiment of the present invention in a flat position.

While the invention is susceptible of embodiment in many different forms, there are shown in the drawings and will herein be described in detail specific embodiments, with the understanding that the present disclosure is to be considered as an example of the principles of the invention and not intended to limit the invention to the specific embodiments shown and described. Further, the terms and words used herein are not to be considered limiting, but rather merely descriptive. In the description below, like reference numbers are used to describe the same, similar, or corresponding parts in the several views of the drawings.

The present invention, according to a preferred embodiment, overcomes problems with the prior art by providing a gurney that enables a patient in a spica cast to be held in an upright position so as to allow the patient to experience a greater degree of comfort. Preferably, the spica cast gurney enables the patient to be easily moved between a prone (lying down on their back or stomach) position and one or more upright positions.

Furthermore, in preferred embodiments, the spica cast gurney allows the patient to be easily transported from room to room with minimal effort. Moreover, in preferred embodiments, the spica cast gurney includes a trapdoor and toilet structure to ease bowel elimination without the discomfort of the usual use of a bedpan. Additionally, in some embodiments, the position of the spica cast gurney can be controlled by the patient using a system for motorized elevation variance.

Figure 2:
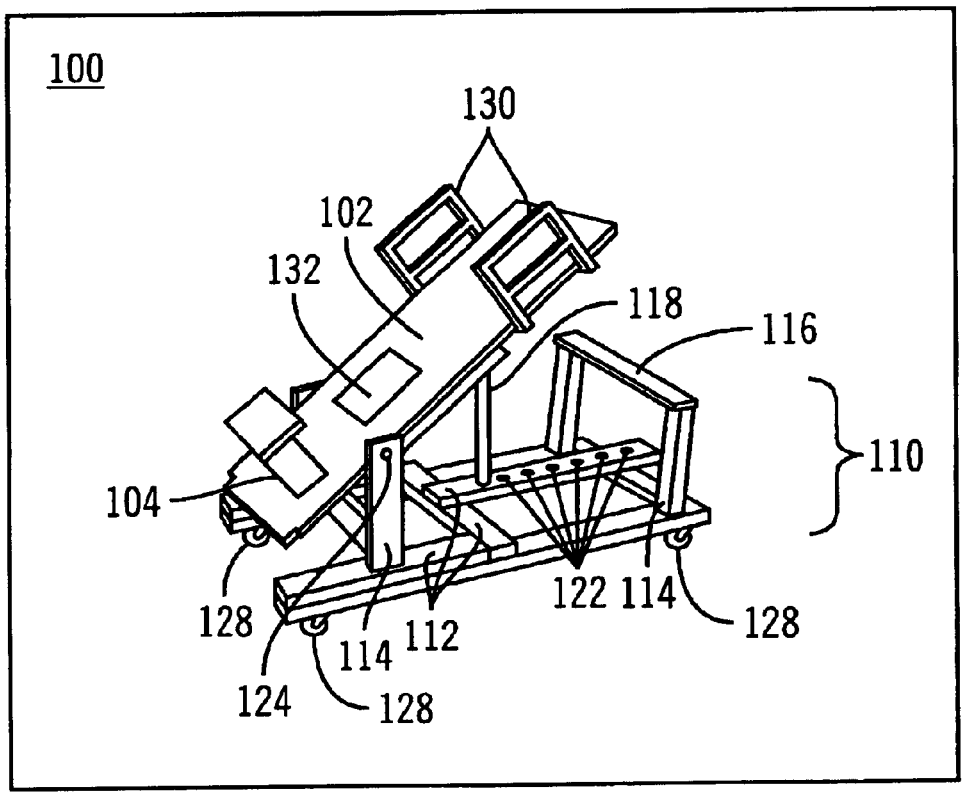
FIG. 2 is a diagram illustrating the spica cast gurney of FIG. 1 in an elevated position.

FIGS. 1 and 2 illustrate a spica cast gurney in accordance with a preferred embodiment of the present invention. Generally, the spica cast gurney 100 according to this preferred embodiment of the present invention comprises a platform 102 mounted to a fixed base structure 110. A bar support structure 104 is coupled to the platform 102. The platform 102 is adjustable, such as between a flat position and various elevated positions.

FIG. 1 illustrates the spica cast gurney 100 in a flat position and FIG. 2 illustrates the spica cast gurney in an elevated position. A patient is positioned on the platform 102 of the spica cast gurney 100. The platform 102 is preferably a rigid, substantially planar one-piece unit that, when raised or lowered, moves as a whole in one rigid piece. As used herein, the terms "elevated", "raised", and "upright" are used interchangeably to refer to any position of the platform 102 that is non-horizontal (i.e., any position of the platform 102 in which one end of the platform 102 is higher off the ground than the other end so as to be non-parallel with the ground). In the "flat" position, the platform 102 is substantially parallel with the ground. In the elevated/raised/upright position, the platform 102 can be at an angle of from 1 to approximately 75 degrees relative to the flat position, which is referred to as the "elevation level" or "height" of the platform 102. Because the platform 102 is designed to hold a patient, the terms "elevated", "raised", and "upright" are also interchangeably used to refer to the position of a patient who is lying on the platform 102 when the platform 102 is in an elevated/raised/upright position. In further embodiments, in the upright position the platform can be at any angle from 1 to 90 degrees.

The bar support structure 104 is attached to or formed integral with the platform 102. The bar support structure 104 functions to support a bar that is fixedly positioned between the legs of a patient in a spica cast, particularly when the platform 102 is in a raised position. In this embodiment, the bar support structure 104 is a box-like structure securely attached to the platform 102. Further, the bar support structure 104 is comprised of a protruding portion 106. The protruding portion 106 forms an overhang that serves to restrain the bar so that the bar does not unintentionally move off of the bar support structure 104. The protruding portion 106 can be a separate member of the bar support structure 104 or can be formed as an integral part of the bar support structure 104.

The platform 102 of this preferred embodiment is coupled to one or more restraint members 130 to help restrain a patient on the platform 102 and to prevent the patient from falling off of the platform 102. Any number, size, and type of restraining members 130 can be positioned at any desired positions about the platform 102. Additionally or alternatively, straps (e.g., Velcro straps) or other devices such as a safety belt can be attached to the platform 102 for securing the patient. Preferably, the platform 102 is coated or formed so as to provide a non-slip surface. In some embodiments, a pillow or adjustable headrest is attached to the platform 102.

Figure 7:
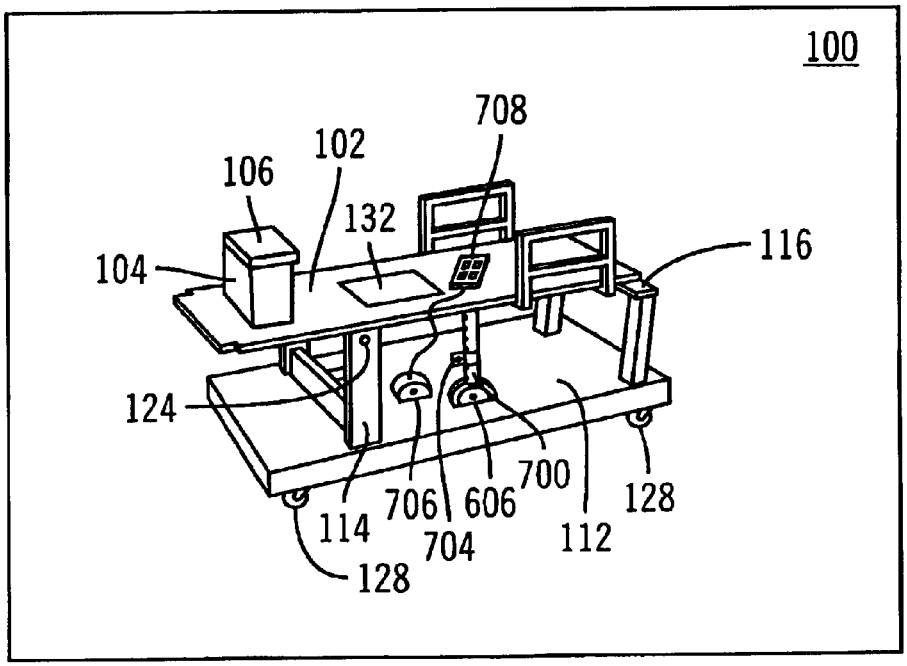
FIG. 7 is a diagram illustrating an isometric view of a spica cast gurney according to an exemplary embodiment of the present invention in the flat position with an exemplary system for motorized elevation variance.

In the preferred embodiment of FIGS. 1 and 2, the base structure 110 of the spica cast gurney 100 functions as a fixed base to hold the platform 102. An unlimited number of possible configurations for the base structure 110 can be utilized, and the base structures 110 depicted and described herein are intended to represent only exemplary embodiments. As illustrated in FIGS. 1 and 2, the exemplary base structure 110 is comprised of a base frame 112 coupled to vertical supports 114. Further, cross supports 116 are included between the vertical supports 114. Thus, the exemplary base structure 110 is comprised of three subcomponents: a base frame 112, vertical supports 114, and cross supports 116. Although two pairs of vertical supports 116 are illustrated in the figures, any suitable number of vertical supports 116 can be employed. The exemplary base frame 112 is comprised of various interconnected members, which can be configured in any desired manner. Alternatively, the base frame 112 can be comprised of a single, substantially planar structure, as shown in FIG. 7.

In the preferred embodiment illustrated in FIGS. 1 and 2, one or more adjustable braces 118 are pivotally interconnected between the platform 102 and the base frame 112 of the base structure 110. In particular, the base structure 110 comprises one or more brace adjustment features 122 which engage one end of the adjustable brace 118, the other end of which is pivotally connected to the platform 102. In this preferred embodiment, the brace adjustment features 122 comprise slots into which the end of the adjustable brace 118 is inserted (i.e., the slots "receive" one end of the adjustable brace 118). These brace adjustment features 122 (slots) are located in a central member of the base frame 112. In further embodiments, the brace adjustment features 122 can be disposed in any number, in any arrangement, and about any portion of the base structure 110 for receiving the brace.

The height of the platform 102 can be adjusted by positioning the adjustable brace 118 at different brace adjustment features 122 (e.g., inserting the adjustable brace 118 into different slots). Accordingly, increasing the number of brace adjustment features 122 enables the platform 102 to be positioned in a greater number of elevated positions. The preferred embodiment has six slots to allow the platform 102 to be positioned in a total of seven positions (six elevated positions plus the flat position in which the adjustable brace 118 is not engaged in any slots).

As shown in the figures, one pair of the vertical supports 114 is coupled to the platform 102 by way of a pivot member 124. When the platform 102 is raised or lowered, the platform 102 pivots around the axis defined by pivot member 124. The pivot member 124 illustratively comprises a rod that is configured so as to be able to rotate freely when the platform 102 is raised or lowered. The platform 102 is securely attached to the pivot member 124, and the pivot member 124 is configured so as to rotatably engage the pair of vertical supports 114. In this embodiment, the pivot member 124 is a rod that fits into holes in the vertical supports 114 such that the pivot member 124 is loosely held so as to be able to rotate within the holes. The fulcrum point of the platform is shown in the preferred position. However, in further embodiments, the fulcrum point can located elsewhere depending on the size of the patient and the desired range of movement.

In the preferred embodiment shown in FIGS. 1 and 2, a cross support 116 is interconnected between the tops of the other vertical supports 114. The cross support 116 contacts and helps support the platform 102 when the platform 102 is in the flat position. The cross support 116 of the preferred embodiment also serves to prevent the platform 102 from dropping below the flat position (i.e., the horizontal level). In further embodiments, the base structure 110 of the gurney is formed such that the patient can be lower below the prone position (i.e., head-down or backward). Further, the base structure 110 can be formed so as to allow the bed to rotate or swivel side-to-side to some degree, so as to provide even more mobility.

In this preferred embodiment, the spica cast gurney 100 also includes wheels 128 attached to the base structure 110. The wheels 128 enable the spica cast gurney 100 and, accordingly, a patient who is situated in the spica cast gurney 100, to be easily transported. This allows, for example, a patient to be moved from room to room with minimal effort. The wheels can be of any suitable size, with larger wheels typically enabling easier transportation of the gurney. In preferred embodiments, a locking device is employed on at least one of the wheels, and preferably on two or more of the wheels, to prevent unintentional movement of the gurney. Any known locking device for preventing the wheel from rolling can be utilized.

Furthermore, in this preferred embodiment, the spica cast gurney 100 includes a trapdoor 132 that can be opened in order to ease bowel elimination without the discomfort of the usual use of a bedpan. A removable toilet 600 (shown in FIG. 6) can be positioned underneath the trapdoor 132.

Although in preferred embodiments the platform 102 is adjustable between a flat position and one or more elevated positions, or between multiple elevated positions, it is not necessary that the platform 102 be so adjustable. In further embodiments, the platform 102 is fixed in one position, such as in circumstances in which a patient needs to be, or desires to be, constantly held in the same position. This fixed position can be any elevated position. Thus, in general terms the present invention relates to a spica cast gurney 100 having a platform 102 that is capable of assuming an elevated position, which includes embodiments in which the platform 102 can be adjusted to one or more elevated positions as well as embodiments in which the platform 102 is fixed in an elevated position.

Figure 3:
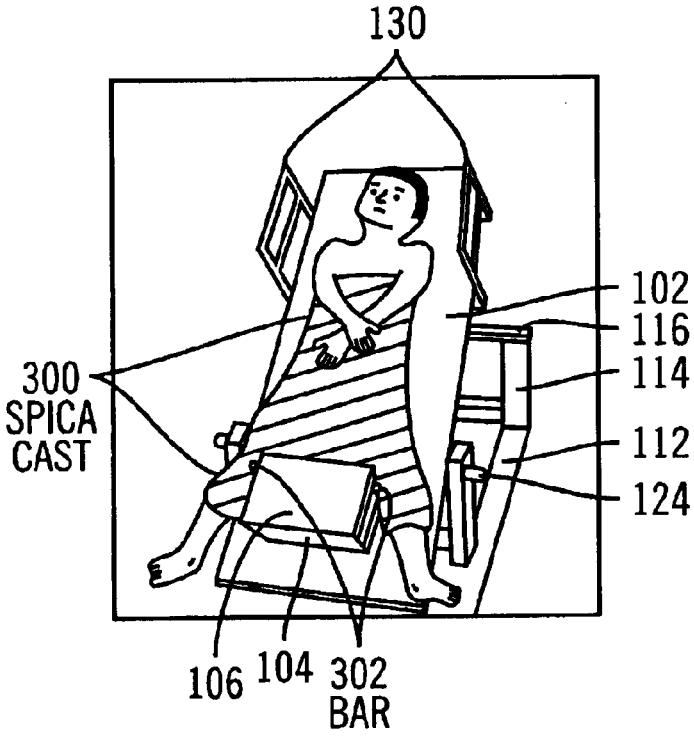
FIG. 3 is a diagram illustrating a front view of a patient wearing a spica cast with a bar between their legs situated in the spica cast gurney of FIG. 1 in an elevated position.
Figure 4:
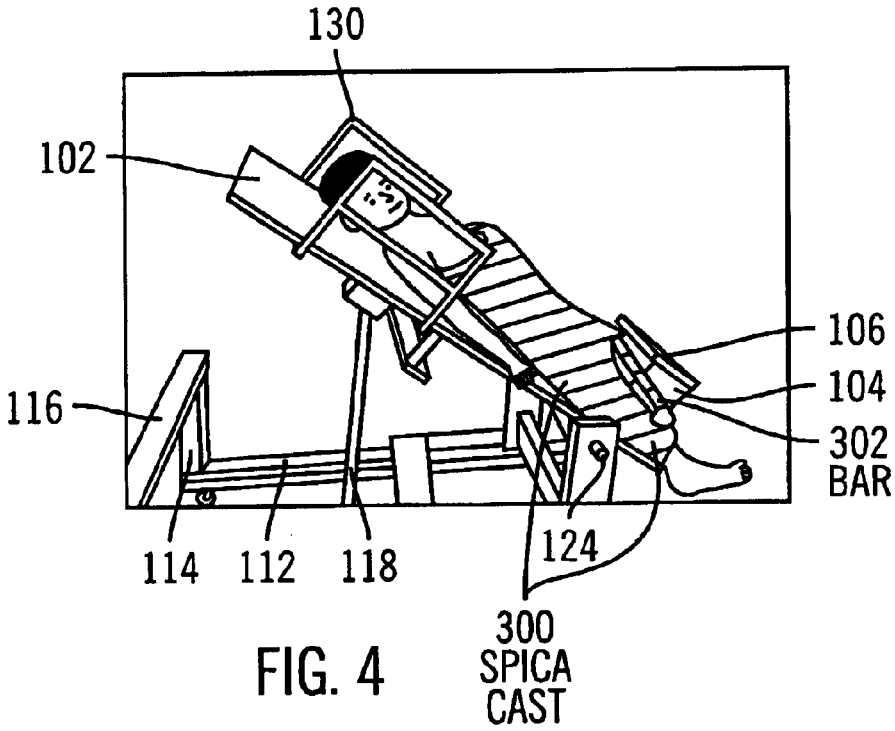
FIG. 4 is a diagram illustrating a side view of the patient situated in the spica cast gurney of FIG. 1 in an elevated position.

FIGS. 3 and 4 illustrate a patient wearing a spica cast with a bar between their legs situated in the spica cast gurney of FIG. 1. FIG. 3 shows a frontal view and FIG. 4 shows a side view of the patient in the spica cast gurney 100. In FIGS. 3 and 4, the spica cast gurney 100 is in an elevated position and the patient is shown lying on their back. Obviously, a patient can also lie in other positions on the spica cast gurney 100, such as on their stomach.

The exemplary patient shown in FIGS. 3 and 4 has a spica cast 300 extending from the chest down to the lower portion of both legs (i.e., beyond the knees). As shown, a bar 302 is fixedly attached to the spica cast so as to extend between the patient's legs. Such a bar 302 (or other equivalent device) is typically used with a spica cast in order to maintain the patient's legs in a fixed, spread apart position for proper healing to be achieved.

As shown in FIGS. 3 and 4, the bar support structure 104 holds the bar 302 when the platform 102 is in an elevated position, so as to prevent the patient from sliding on the platform 102. Thus, the bar support structure 104, by supporting the bar 302, supports the patient when the platform 102 is in an elevated position. In the preferred embodiment shown in FIGS. 3 and 4, the protruding portion 106 forms an overhang that serves to prevent the bar 302 from sliding off of the bar support structure 104.

While an exemplary box-like bar support structure 104 is illustrated in FIGS. 1–4, a wide variety of other types of bar support structures 104 are used in further embodiments. The bar support structure 104 can take the form of virtually any structure that is sufficiently strong and of a suitable shape to support the bar 302 (and thus the patient) when the platform 102 is in an elevated position. Examples of some alternative bar support structures 104 that can be used are illustrated in FIGS. 5A, 5B, 5C, and 5D.

Figure 5A:
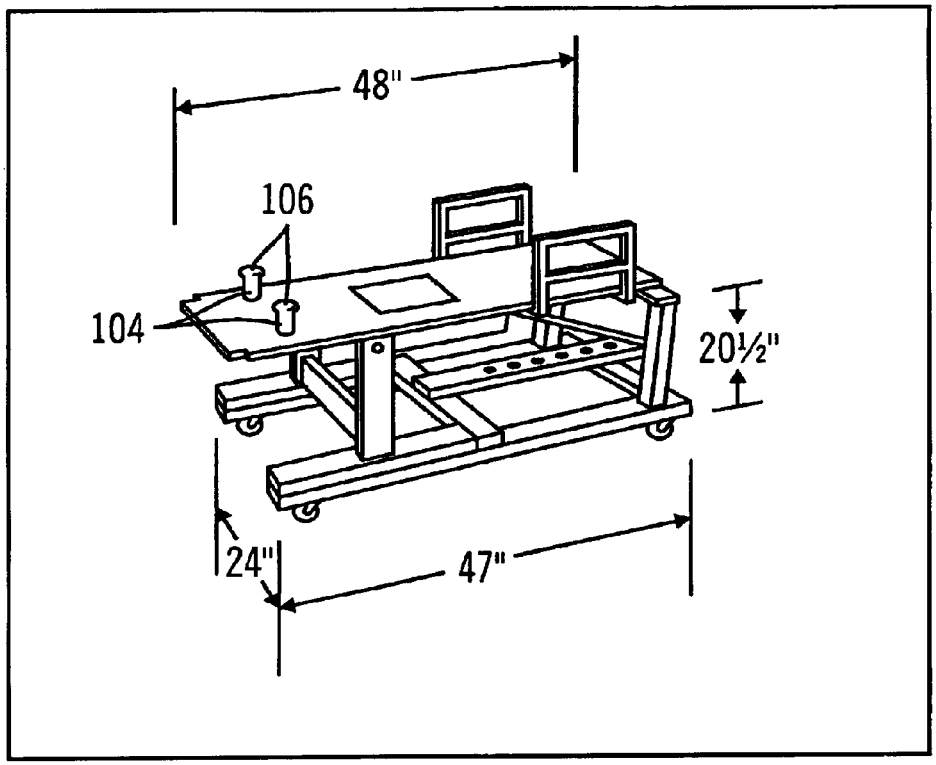
FIG. 5A is a diagram illustrating a spica cast gurney according to another embodiment of the present invention in a flat position.

FIG. 5A is a diagram illustrating a spica cast gurney according to another embodiment of the present invention in the flat position. The spica cast gurney of FIG. 5A is the same as that of FIGS. 1–4, with the exception that an alternative bar support structure 104 is used. As shown in FIG. 5A, the bar support structure 104 takes the form of multiple peg-like structures rather than the box-like structure shown in FIGS. 1–4. The platform 102 has holes for receiving the bar support structure 104 in the form of two or more pegs, each of which has a protruding portion 106. The platform can have any number and arrangement of such holes, for accommodating any number of pegs at different position so as to allow adjustment of the location of the bar support structure. This allows the gurney to better accommodate patients of different heights or spica casts with different bar locations. In further embodiments, any shape of peg can be employed, with or without a protruding portion 106.

Figure 5B:
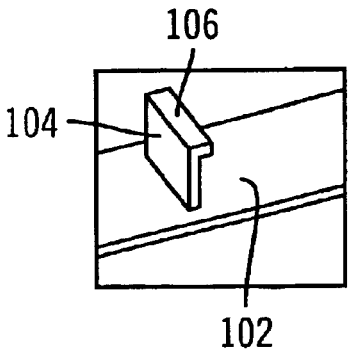
FIGS. 5B, 5C, and 5D illustrate alternative bar support structures for the spica cast gurney according to further embodiments of the present invention.
Figure 5C:
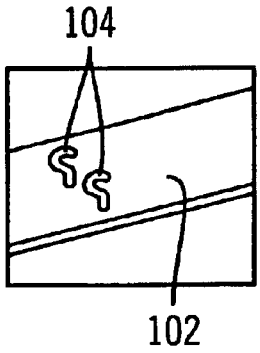
Figure 5D:
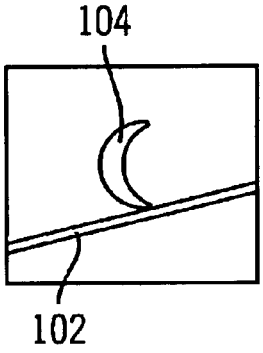

Examples of further alternative bar support structures 104 are shown in FIGS. 5B, 5C, and 5D, with FIGS. 5B and 5C being isometric views, and FIG. 5D being a side view. These alternative bar support structures 104 include a substantially flat and planar structure with a protruding portion 106 (FIG. 5B), two or more hooks 104 (FIG. 5C), and a trough-like structure 104 that is attached or formed integral with the platform 102 (FIG. 5D). In further embodiments, any structure 104 that is capable of securing the bar can be removably attached, fixedly attached, or integral with the platform 102.

Figure 6:
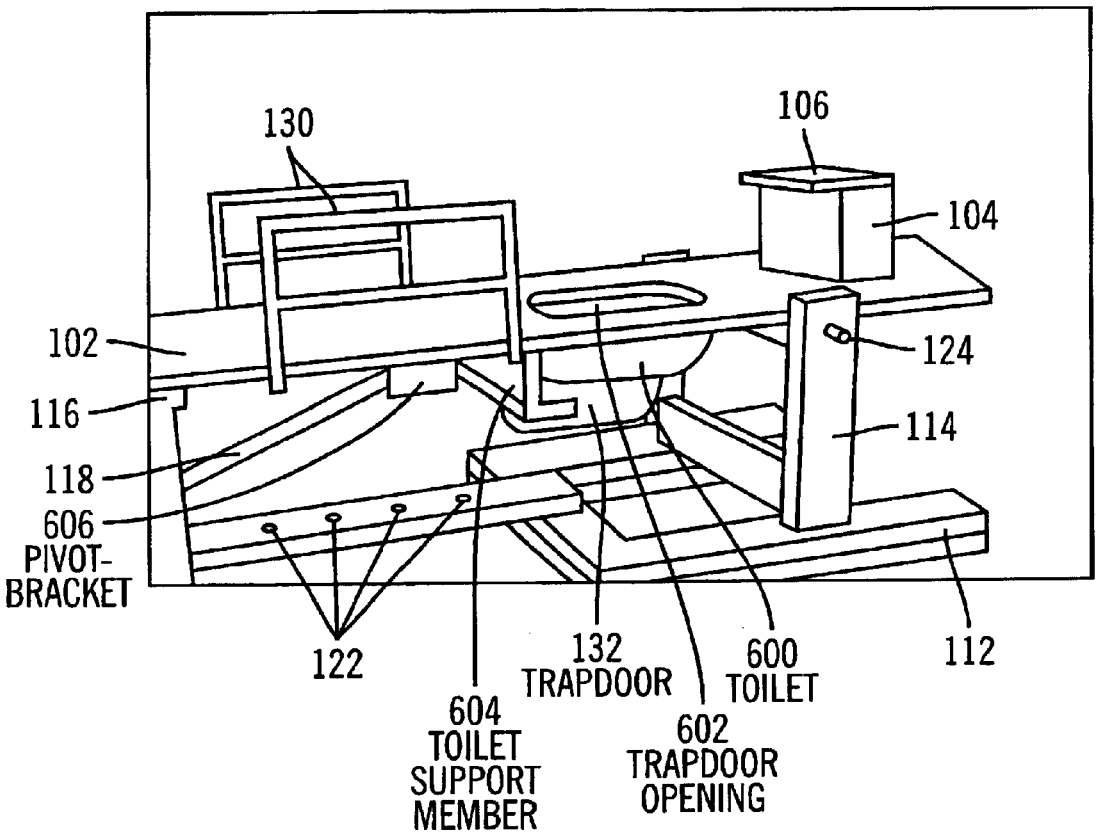
FIG. 6 is a diagram illustrating a side view of the spica cast gurney of FIG. 1 showing the trapdoor and toilet structure.

FIG. 6 is a diagram illustrating a side view of the spica cast gurney of FIG. 1. As shown, a toilet structure 600 is located underneath a trapdoor opening 602. The trapdoor 132 is shown in the open position. The trapdoor 132 opens by pivoting down towards the ground. In the closed position, the trapdoor 132 is positioned so as to close off the trapdoor opening 602. Alternatively, the trapdoor 132 can open by sliding underneath the platform 102 away from the opening.

In this preferred embodiment, the toilet 600 is removable. Thus, when the patient needs to use the toilet 600, the trapdoor 132 can be opened, and the toilet 600 can be positioned underneath the trapdoor opening 602. When the patient is finished, the toilet 600 can be removed and the trapdoor 132 can be repositioned so as to close off the trapdoor opening 602. Various structures, such as toilet support member 604, can be incorporated into the spica cast gurney 100 in order to support the toilet 600 underneath the trapdoor opening 602 and to facilitate easy and secure removable placement of the toilet 600 underneath the trapdoor opening 602. In some embodiments, the trapdoor opening is made longer or moveable so as to better accommodate patients of different sizes.

FIG. 6 also shows that the adjustable brace 118 is pivotally coupled to the bottom side of the platform 102. In this preferred embodiment, the adjustable brace 118 is not directly coupled to the platform 102, but rather is pivotally coupled to a pivot bracket 606, and the pivot bracket 606 is attached to the bottom of the platform 102. Either or both ends of the adjustable brace can be pivotally connected by such a pivot bracket to either or both of the platform and the base structure. The pivot brackets 606 facilitate pivoting of the adjustable brace 118, and can be any conventional pivot bracket, such as a pivot bracket that comprises a removable pivot pin.

As described above, in the preferred embodiment, the brace adjustment features 122 comprise a plurality of slots into which an end of the adjustable brace 118 is inserted. However, in further embodiments, a variety of different types of brace adjustment features 122 are utilized to adjust the height of the platform 102. For example, knobs or other protrusions can be implemented that function as blocks to restrain the adjustable brace 118 in a desired position, without the need for inserting the adjustable brace 118 into a slot or other cavity. Again, any desired number and arrangement of such knobs or other protrusions can be implemented.

In other embodiments, the position of the adjustable brace 118 can be adjusted using a mechanism comprising a series of holes in combination with a pin, with the pin being inserted into the desired hole to secure the platform 102 at the desired elevation. Such a mechanism is commonly used in weightlifting or other exercise equipment. For example, the base structure 110 can have a track (e.g., a groove) that engages the adjustable brace 118 and which allows the adjustable brace 118 to slide in a linear direction back and forth. One or more pins can be inserted into one or more of any number of holes to prevent the adjustable brace 118 from sliding so as to restrain the adjustable brace 118 in a position corresponding to a desired elevation of the platform 102. The adjustable brace 118 preferably has one or more holes into which the pin can be inserted such that the pin can be simultaneously inserted through holes in the track and the hole in the adjustable brace, so as to very securely position the adjustable brace 118. Alternatively, the mechanism can be designed such that the pin is not inserted into the adjustable brace, but rather is inserted only through holes in the track, so as to create an obstruction in the track that the adjustable brace 118 cannot cross.

In yet other embodiments, instead of slots, knobs, protrusions, or holes into which a pin can be inserted, or other discrete adjustment points, a linear adjustment mechanism can be implemented. In one such embodiment, the adjustable brace 118 engages a track in the base structure 110 that allows the adjustable brace 118 to slide in a linear direction back and forth in a similar fashion as described above. However, instead of discrete holes into which a pin is inserted, one or more sliding components (e.g., "clamps", "blocks", or "stops") can be incorporated so as to slide along the track (either independently from the adjustable brace 118, or coupled to the adjustable brace 118). These are tightened down (e.g., by using a screw, bolt, or other fastener) in order to restrain the adjustable brace 118 at any desired position.

Regardless of the type of brace adjustment features 122 employed for adjusting the height of the platform 102, the brace adjustment features 122 can be disposed about any portion of the base structure 110, and in any desired arrangement. Additionally, multiple adjustable braces 118 can be utilized. Using multiple adjustable braces 118 provides additional strength so as to give an extra degree of safety.

Figure 8:
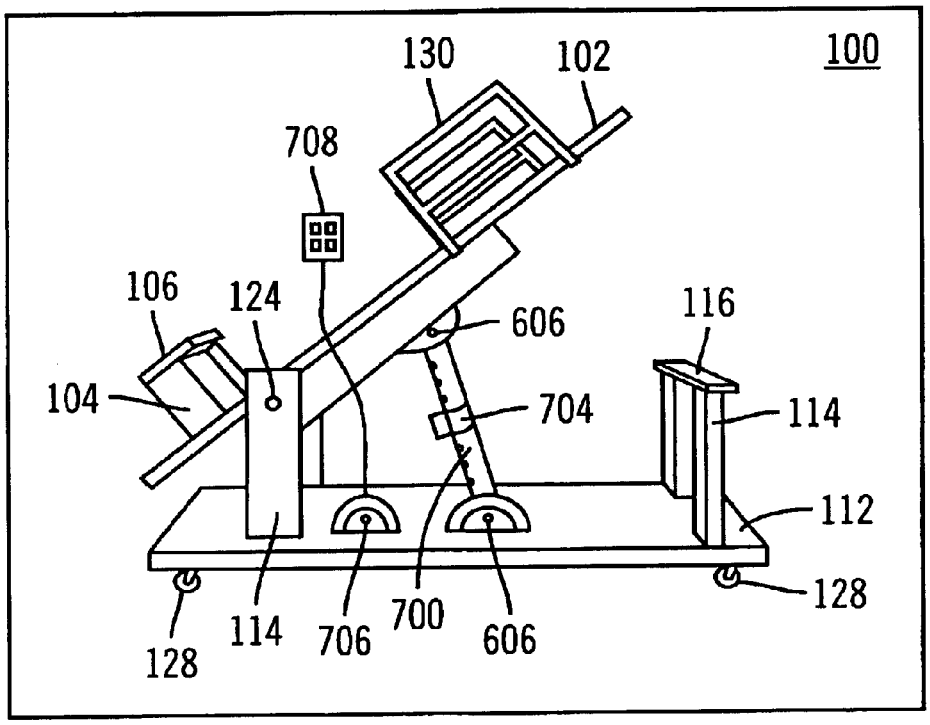
FIG. 8 is a diagram illustrating a side view of the spica cast gurney of FIG. 7.
Figure 1:
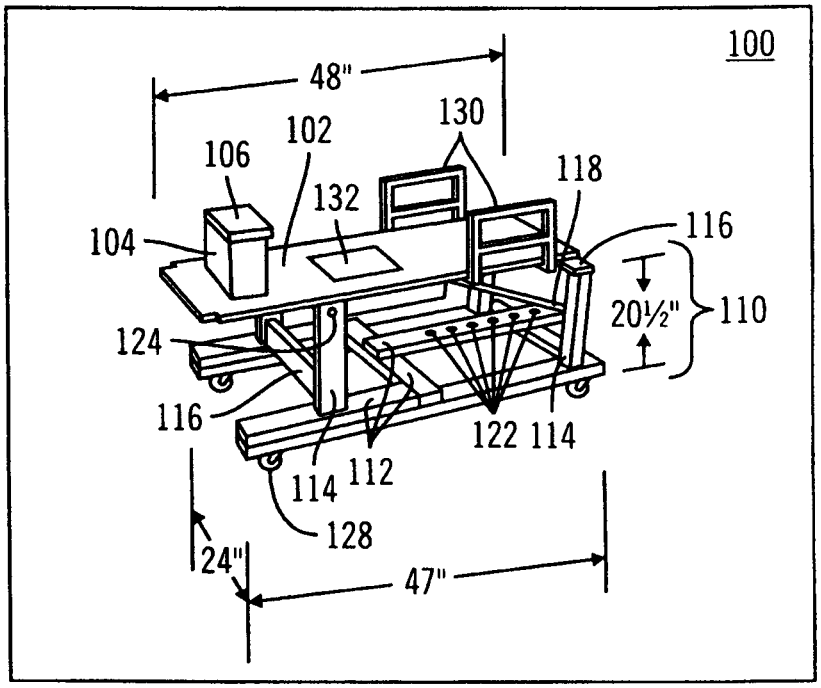
Figure 2:
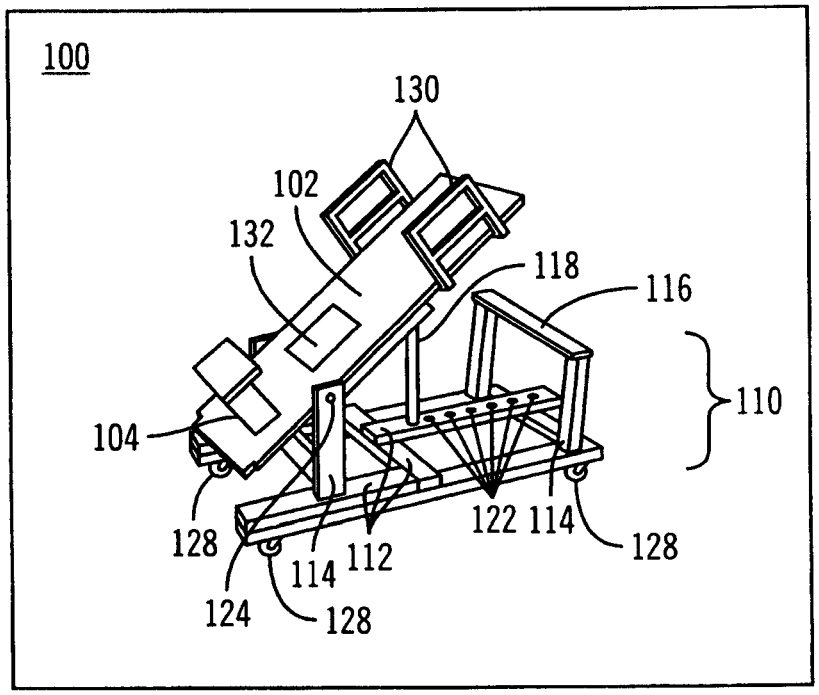
Figure 3:
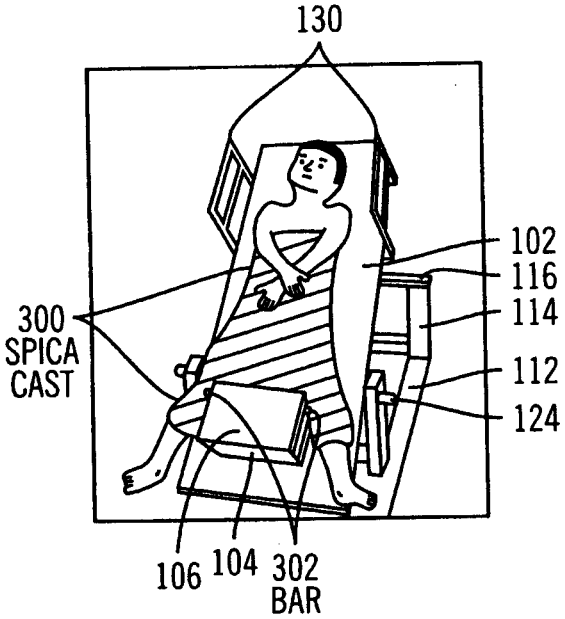
Figure 4:
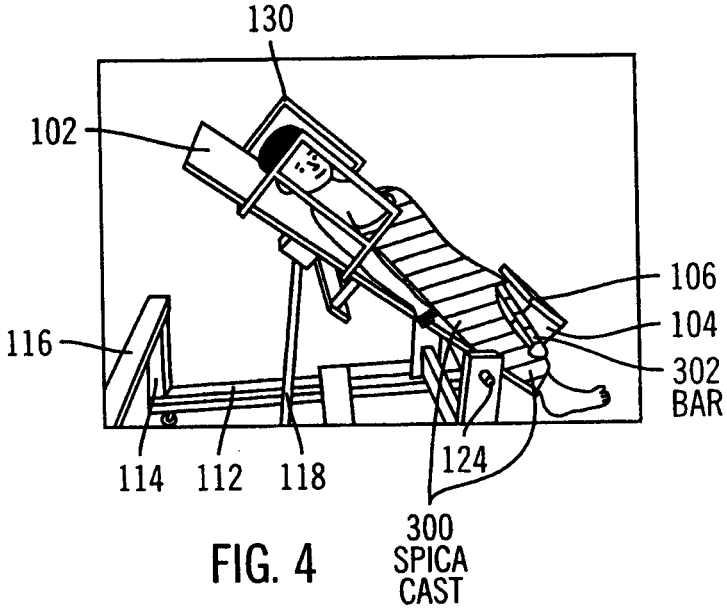
Figure 5A:
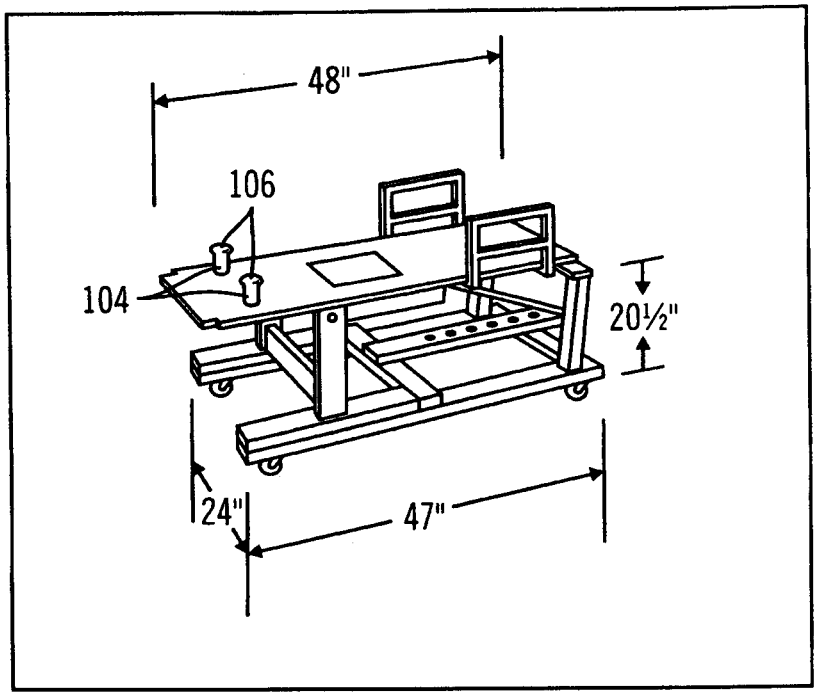
Figures 5B, 5C, 5D:
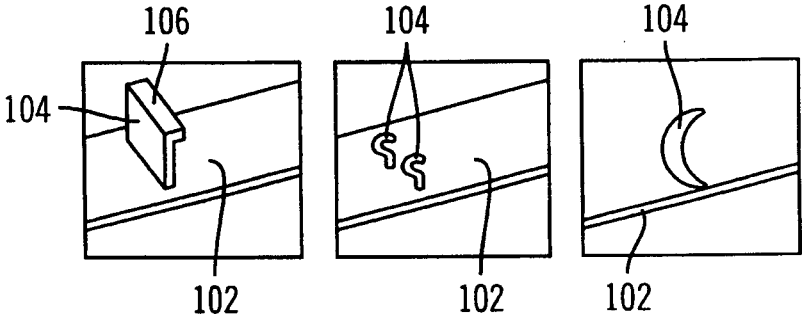
Figure 6:
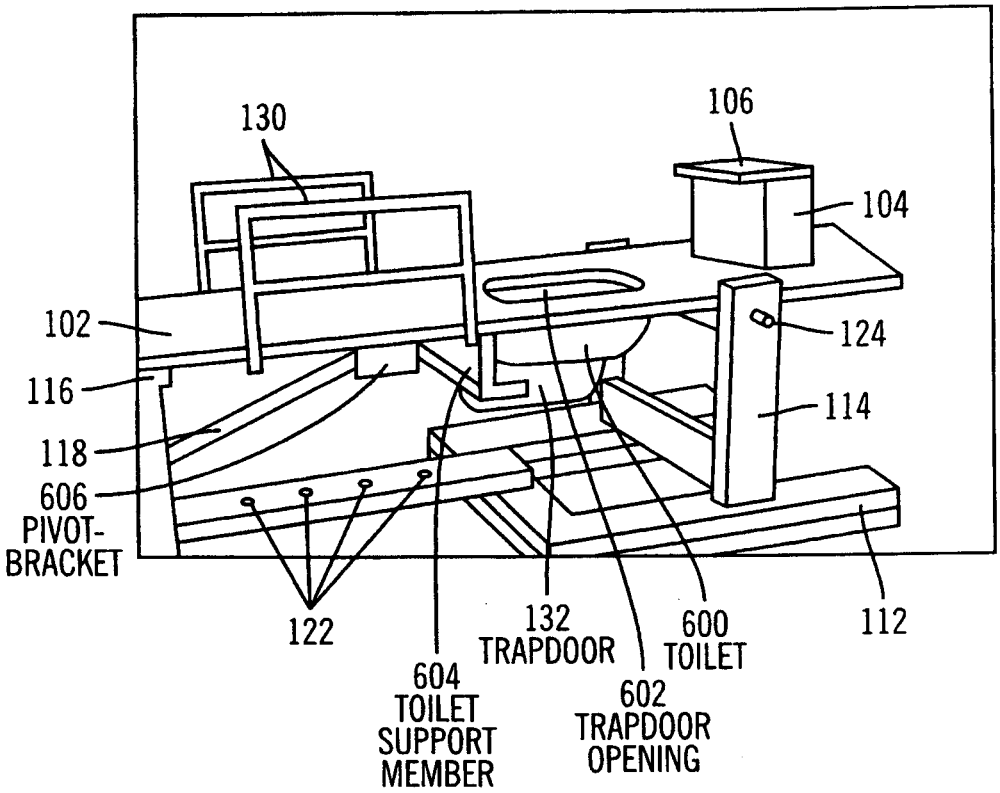
Figure 7:
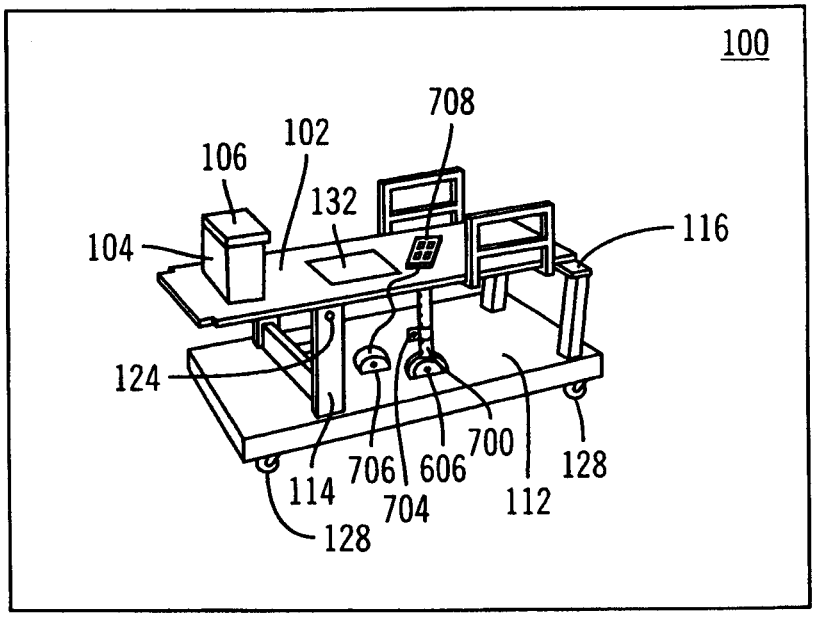
Figure 8:
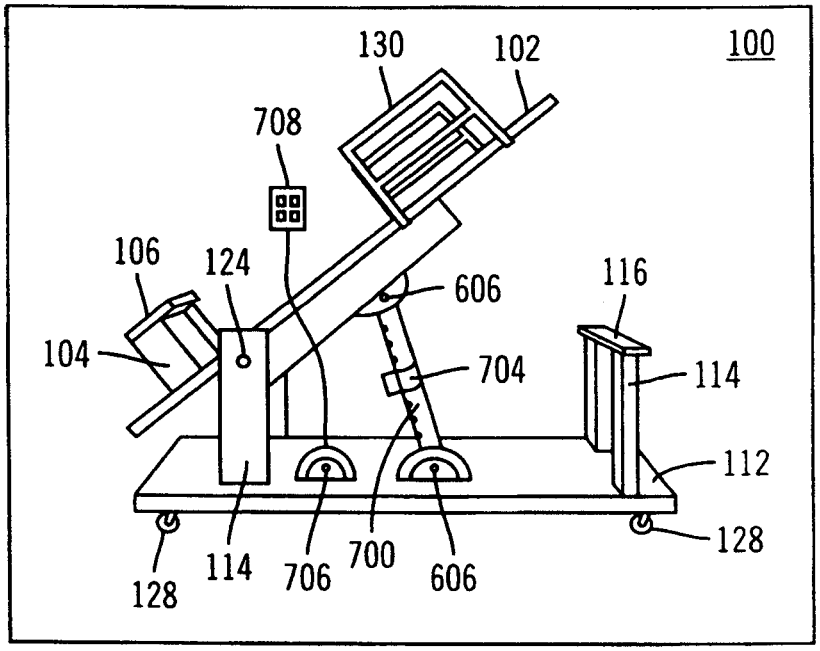

FIGS. 7 and 8 illustrate a spica cast gurney according to an exemplary embodiment of the present invention in which a motorized elevation variance system is provided for adjusting the elevation level of the platform. FIG. 7 shows an isometric view of the spica cast gurney 100 in the flat position, while FIG. 8 shows a side view of the spica cast gurney 100 in an elevated position.

In FIGS. 7 and 8, the motorized elevation variance system for raising and lowering the platform 102 about the axis defined by pivot member 124 comprises an electrically-operated screw jack 700. The electrically-operated screw jack 700 can be extended and retracted in a conventional manner by an electric motor 704. Electrical controls for the electric motor 704 can be located in a control box 706, and limit switches are preferably provided for automatically terminating operation of the electric motor 704 when the platform 102 reaches the flat position or the highest vertical position.

The electrically-operated screw jack 700 can be pivotally connected by a pivot bracket 606 at one or both ends to either or both of the platform 102 and the base structure 110. The pivot brackets 606 facilitate pivoting of the electrically-operated screw jack 700, and any conventional pivot bracket can be utilized, such as a pivot bracket that comprises a removable pivot pin. In the exemplary embodiment shown in FIGS. 7 and 8, the electrically-operated screw jack 700 is pivotally connected by a pivot bracket 606 at its upper end to the platform 102, and is also pivotally connected by a second pivot bracket 606 at its lower end to the base structure 110. FIG. 7 also illustrates an embodiment in which the base frame 112 is formed by a substantially single and planar structure.

A hand-held control 708 can be utilized in conjunction with the motorized elevation variance system. The hand-held control 708 is coupled to the control box 706 by a wire (as shown in FIGS. 7 and 8) or a wireless connection. By using the hand-held control 708, a patient can easily raise and lower the platform 102 to any desired height, without the need for assistance from another individual. The preferred hand-held control 708 comprises one button for raising the platform 102 and a second button for lowering the platform 102. Alternatively, the hand-held control 708 can comprise a single toggle switch that can be moved in one direction to raise the platform 102 and moved in another direction to lower the platform 102. In further embodiments, buttons, toggle switches, or other controls (e.g., foot pedals) for controlling the elevation level of the platform 102 are situated in one or more locations about the spica cast gurney 100, such as in a portion of the base structure 110, rather than (or in addition to) being located in a hand-held control 708.

Although the motorized elevation variance system depicted in FIGS. 7 and 8 comprises an electrically operated screw jack 700, any other alternative system for motorized elevation variance can be utilized. For example, in further embodiments, a hydraulic cylinder/piston and a pneumatic cylinder/piston (e.g., nitrogen-filled gas shocks) are utilized. Furthermore, multiple jacks or cylinders or other devices can be utilized. In one embodiment, the entire gurney is motorized to allow the patient to move about the house without assistance.

The spica cast gurney of the present invention can be constructed of any suitable material that provides sufficient strength to hold a patient. For example, the spica cast gurney can be constructed of wood, metal (e.g., steel), or light-weight non-porous materials such as various plastics. Moreover, different components of the spica cast gurney can be constructed of different materials.

Further, the platform and/or the bar support structure can be padded in order to increase the comfort of the patient. For example, one or more cushions or mattresses can be mounted on the platform and/or the bar support structure (such as where the patient's head, shoulders, and arms rest on the platform). Further, a bar support structure in the form of a box-like structure can be solid or can have an internal chamber. An internal chamber within the bar support structure can be used, for example, to store various items or accessories.

The present invention offers significant advantages. The spica cast gurney of the present invention enables a patient wearing a spica cast to experience a more comfortable existence and a greater degree of convenience compared with the existence that such a patient currently has to endure. For example, the spica cast gurney enables a patient in a spica cast to be supported in one or more upright positions. In an upright position, the patient can more easily eat, read, and perform some basic functions with no or minimal assistance. Furthermore, in preferred embodiments, the spica cast gurney enables the position of the patient to be easily adjusted between a prone position and one or more upright positions. Additionally, in preferred embodiments, the spica cast gurney includes wheels that enable a patient to be easily transported and to be situated in an upright position while being transported. This allows the patient to be easily moved around to participate in various family activities such as mealtime or television viewing.

Furthermore, preferred embodiments of the spica cast gurney include a trapdoor to avoid the usual use of a bedpan. In some embodiments, the height of the platform can be controlled by the patient using a hand-held control. Thus, a patient can use a hand-held control 708 to automatically raise the platform 102 from the flat position to an upright position (e.g., in order to read, eat, etc.), and then can lower the platform 102 back to the flat position (e.g., in order to sleep, etc.).

While there has been illustrated and described what are presently considered to be the preferred embodiments of the present invention, it will be understood by those skilled in the art that various other modifications may be made, and equivalents may be substituted, without departing from the true scope of the present invention. Additionally, many modifications may be made to adapt a particular situation to the teachings of the present invention without departing from the central inventive concept described herein. Furthermore, an embodiment of the present invention may not include all of the features described above. Therefore, it is intended that the present invention not be limited to the particular embodiments disclosed, but that the invention include all embodiments falling within the scope of the appended claims.

What is claimed is:

1. A gurney for a patient wearing a spica cast with a bar, the bar being fixedly attached to the spica cast so as to extend between the patient's legs in order to maintain the patient's legs in a fixed spread apart position, said gurney comprising:

a base structure;

a platform for holding the patient, the platform being coupled to the base structure and being capable of being in at least one elevated position; and a bar support structure for supporting the bar that is fixedly attached to the spica cast so as to extend between the patient's legs when the platform is in the elevated position so as to support the patient wearing the spica cast with the bar when the platform is in the elevated position, the bar support structure being coupled to the platform.

2. The gurney of claim 1, wherein the platform is also capable of being in a flat position.

3. The gurney of claim 1, wherein the platform is immovably fixed in the elevated position.

4. The gurney of claim 1, wherein the platform is rigid so as to always be substantially planar.

5. The gurney of claim 1, wherein the bar support structure comprises a box structure.

6. The gurney of claim 5, wherein the bar support structure further comprises a protruding portion forming an overhang that restrains the bar so as to prevent the bar from moving off of the bar support structure when the platform is in the elevated position.

7. The gurney of claim 1, wherein the bar support structure comprises one of at least one hook and at least one trough.

8. The gurney of claim 1, wherein the platform includes a trapdoor opening, and the gurney further comprises:

a toilet is removably mounted underneath the trapdoor opening; and a toilet support member for supporting the toilet underneath the trapdoor opening and facilitating removable mounting of the toilet underneath the trapdoor opening.

9. The gurney of claim 1, further comprising at least one adjustable brace coupled between the platform and the base structure.

10. The gurney of claim 9, wherein the base structure includes at least one brace adjustment feature for allowing the adjustable brace to be secured so as to support the platform in the elevated position.

11. The gurney of claim 9, wherein the base structure includes a plurality of brace adjustment features for allowing the adjustable brace to be secured so as to support the platform in a plurality of elevated positions.

12. The gurney of claim 11, wherein the brace adjustment features comprise a plurality of slots for receiving an end of the adjustable brace.

13. The gurney of claim 1, further comprising a pivot member interconnected to the platform and the base structure, the platform rotating about an axis defined by the pivot member.

14. The gurney of claim 1, wherein the bar support structure includes a protruding portion forming an overhang that restrains the bar so as to prevent the bar from moving off of the bar support structure when the platform is in the elevated position.

15. The gurney of claim 1, wherein the bar support structure comprises:

a substantially flat planar structure; and a protruding portion forming an overhang on an end of the planar structure for restraining the bar so as to prevent the bar from moving off of the end of the planar structure when the platform is in the elevated position.

16. The gurney of claim 1, wherein the bar is fixedly attached to the spica cast at or below the patient's knees.

17. A gurney for a patient wearing a spica cast with a bar, the bar being fixedly attached to the spica cast so as to extend between the patient's legs in order to maintain the patient's legs in a fixed spread apart position, said gurney comprising:

a base structure;

a platform for holding the patient, the platform being coupled to the base structure and being capable of being in a plurality of elevated positions;

a bar support structure for supporting the bar that is fixedly attached to the spica cast so as to extend between the patient's legs when the platform is in the elevated position so as to support the patient wearing the spica cast with the bar when the platform is in one of the elevated positions, the bar support structure being coupled to the platform; and a motorized elevation variance system coupled between the platform and the base structure for changing the elevated position of the platform, wherein the platform is rigid so as to always be substantially planar.

18. The gurney of claim 17, wherein the motorized elevation variance system comprises at least one electrically-operated screw jack.

19. The gurney of claim 17 wherein the motorized elevation variance system comprises at least one hydraulic cylinder and piston.

20. The gurney of claim 17, wherein the motorized elevation variance system comprises at least one pneumatic cylinder and piston.

21. The gurney of claim 17, further comprising a hand-held control coupled to the motorized elevation variance system for controlling the motorized elevation variance system.

22. A gurney for a patient wearing a spica cast with a bar, the bar being fixedly attached to the spica cast so as to extend between the patient's legs in order to maintain the patient's legs in a fixed spread apart position, said gurney comprising:

a base structure;

a platform for holding the patient, the platform being coupled to the base structure and being capable of being in at least one elevated position; and means for supporting the bar, which is fixedly attached to the spica cast so as to extend between the patient's legs, when the platform is in the elevated position so as to support the patient wearing the spica cast with the bar when the platform is in the elevated position.

* * * * *

UNITED STATES PATENT AND TRADEMARK OFFICE

CERTIFICATE OF CORRECTION

PATENT NO. : 6,954,951 B2
APPLICATION NO. : 10/734874
DATED : October 18, 2005
INVENTOR(S) : Lieboff et al.

It is certified that error appears in the above-identified patent and that said Letters Patent is hereby corrected as shown below:

The title page showing the illustrative figure should be deleted to be replaced with the attached title page.

In the drawing sheets, consisting of Figs. 1-7, should be deleted to be replaced with the drawing sheets, consisting of Figs. 1-7, as shown on the attached pages.

Signed and Sealed this
Fourteenth Day of June, 2011

David J. Kappos

David J. Kappos
*Director of the United States Patent and Trademark Office*

(12) United States Patent
Lieboff et al.

(10) Patent No.: US 6,954,951 B2
(45) Date of Patent: Oct. 18, 2005

(54) SPICA CAST GURNEY

(76) Inventors: Leonard Lieboff, 10536 Plainview Cir., Boca Raton, FL (US) 33498; John DelGardo, 11769 Preservation La., Boca Raton, FL (US) 33498

( * ) Notice: Subject to any disclaimer, the term of this patent is extended or adjusted under 35 U.S.C. 154(b) by 0 days.

(21) Appl. No.: 10/734,874

(22) Filed: Dec. 12, 2003

(65) Prior Publication Data

US 2005/0125898 A1 Jun. 16, 2005

(51) Int. Cl.[7] ..... A61G 7/075

(52) U.S. Cl. ..... 5/603; 5/604; 5/610; 5/621; 5/624

(58) Field of Search ..... 5/603, 604, 610, 5/621, 624, 648, 650; 128/845

(56) References Cited

U.S. PATENT DOCUMENTS

| | | | | |
|---|---|---|---|---|
| 2,035,321 A | | 3/1936 | Koenigkramer et al. | |
| 3,293,667 A | * | 12/1966 | Ohrberg | 5/610 |
| 3,423,773 A | * | 1/1969 | Yamate | 5/610 |
| 3,431,020 A | * | 3/1969 | Tyndall | 297/467 |
| 3,434,165 A | * | 3/1969 | Keane | 5/608 |
| 3,640,520 A | * | 2/1972 | Wieland et al. | 5/610 |
| 3,997,926 A | * | 12/1976 | England | 5/610 |
| 4,059,255 A | | 11/1977 | Perold | |
| 4,361,916 A | | 12/1982 | McDaniel | |
| 4,613,997 A | | 9/1986 | Langdale | |
| 4,724,554 A | | 2/1988 | Kowalski et al. | |
| 4,847,929 A | | 7/1989 | Pupovic | |
| 4,865,303 A | | 9/1989 | Hall | |
| 4,987,622 A | | 1/1991 | Shockey | |
| 5,138,729 A | | 8/1992 | Ferrand | |
| 5,303,437 A | | 4/1994 | Hung | |
| 5,489,258 A | | 2/1996 | Wohnsen et al. | |
| 5,586,349 A | | 12/1996 | Hannant | |
| 6,282,736 B1 | | 9/2001 | Hand et al. | |
| 6,405,393 B2 | | 6/2002 | Megown | |
| 6,484,332 B2 | | 11/2002 | Korver, II et al. | |

* cited by examiner

*Primary Examiner*—Michael Trettel
(74) *Attorney, Agent, or Firm*—Stephen Bongini; Fleit, Kain, Gibbons, Gutman, Bongini & Bianco P.L.

(57) ABSTRACT

A gurney is provided for a patient wearing a spica cast with a fixed bar extending between the legs. The gurney includes a base structure, a platform for holding the patient, and a bar support structure coupled to the platform. The platform is coupled to the base structure and is capable of being in at least one elevated position. The bar support structure supports the bar so as to support the patient when the platform is in the elevated position. In one embodiment, the gurney further includes a motorized elevation variance system coupled between the platform and the base structure for changing the elevated position of the platform, and the platform is rigid so as to always be substantially planar.

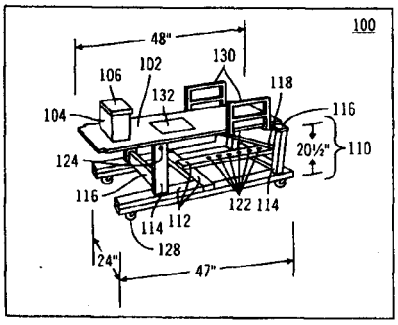

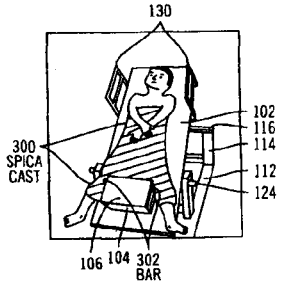

22 Claims, 7 Drawing Sheets